United States Patent [19]

Backlund

[11] 4,314,603

[45] Feb. 9, 1982

[54] SYSTEM FOR DRYING HUMID AIR

[76] Inventor: Anders D. Backlund, Holmer, S-820 90 Ytterhogdal, Sweden

[21] Appl. No.: 50,243

[22] Filed: Jun. 20, 1979

[30] Foreign Application Priority Data

Jun. 22, 1978 [SE] Sweden ..... 7807188

[51] Int. Cl.[3] ..... F28B 9/08

[52] U.S. Cl. ..... 165/57; 62/93; 62/272; 62/317; 165/111; 165/143; 165/144

[58] Field of Search ..... 165/111, 56, 54, 53, 165/55, 57, 143, 144, 145; 62/93, 263, 271, 444, 272, 317

[56] References Cited

U.S. PATENT DOCUMENTS

| | | | |
|---|---|---|---|
| 2,069,430 | 2/1937 | Voss | 165/111 |
| 2,226,061 | 12/1940 | Kershaw | 165/57 |
| 3,148,727 | 9/1964 | Meckler | 165/49 |
| 3,354,946 | 11/1967 | Dean, Jr. | 165/50 |
| 3,359,753 | 12/1967 | Fiedler et al. | 62/93 |
| 3,693,705 | 9/1972 | Stotz | 165/50 |

FOREIGN PATENT DOCUMENTS

| | | | |
|---|---|---|---|
| 2205775 | 8/1973 | Fed. Rep. of Germany | 165/111 |
| 1289595 | 12/1962 | France | 165/143 |
| 684306 | 12/1952 | United Kingdom | 165/180 |
| 1585528 | 3/1981 | United Kingdom | 165/53 |

*Primary Examiner*—Sheldon J. Richter
*Attorney, Agent, or Firm*—Steele, Gould & Fried

[57] ABSTRACT

A system for drying humid air to be used for ventilating a space defined by an enclosing covering, wherein said covering contains a first conduit system for circulating a cooling fluid, and a second conduit system for circulating humid air to be dried. At least part of said first system is in heat exchanging contact with said second system so as to cause condensation of water vapor contained in the humid air flowing in said second conduit system. Means are preferably provided for collecting the condensed water.

5 Claims, 3 Drawing Figures

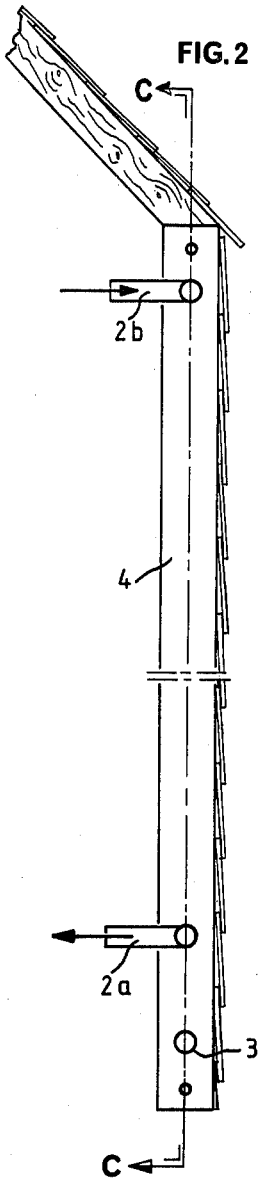
FIG. 2
FIG. 3
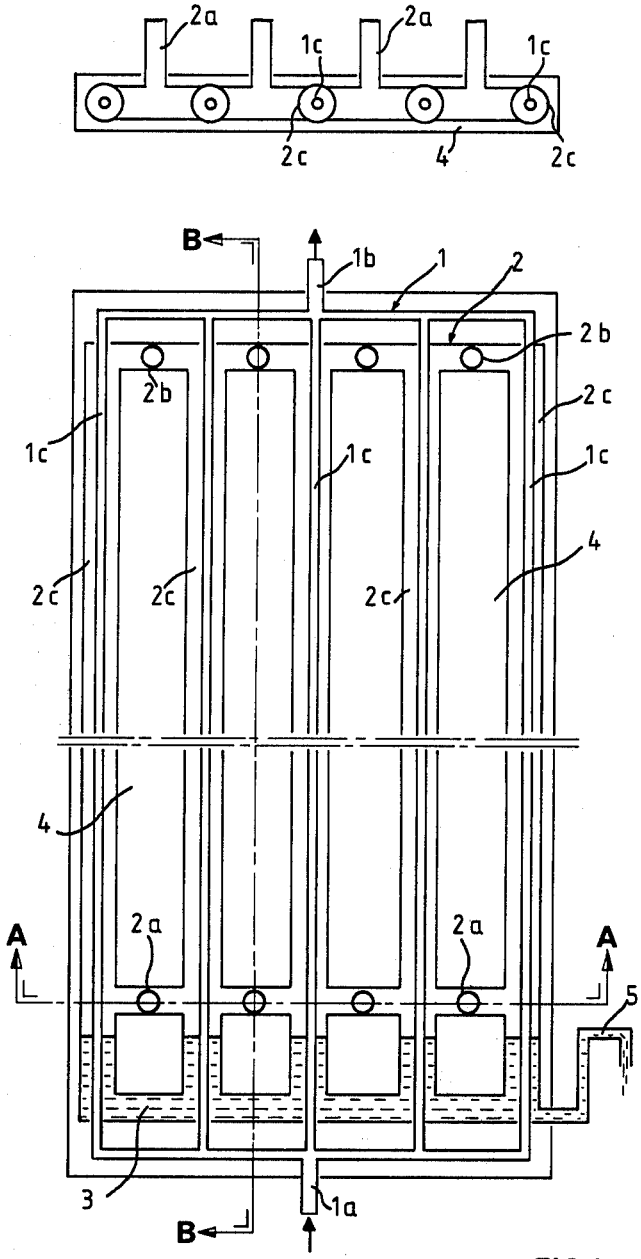
FIG. 1

SYSTEM FOR DRYING HUMID AIR

The present invention relates to a system for drying humid air, in particular air being used for ventilating spaces enclosed by an outer covering, such as the rooms in a building structure.

To control the indoor temperature in buildings, etc. heating and conditioning systems based upon control of the temperature in the outer covering of a building may be used. For example, my German "Offenlegungsschrift" No. 27 29 635, which is incorporated by reference herein, discloses a heating and conditioning system, which operates with a heat exchange system arranged within the outer covering of a building and a ground accumulator for supply and withdrawal of heat energy to and from said heat exchange system by means of one or more circulation pumps. By this system it is possible to make the indoor temperature generally follow the 24 hours average temperature without requiring thick or otherwise heat storing roof and wall constructions of the building. In regions where this 24 hours average temperature is too low for obtaining the desired indoor temperature, the system may be supplemented by, for example, a fan and/or a heat pump system to raise the indoor temperature. In regions where the 24 hours average temperature is too high, the same system may be used to lower the temperature. The system is therefore suitable for all places on the earth. A great problem is, however, that a high atmospheric humidity may render the desired temperature reduction difficult due to uncontrolled condensation of moisture.

The present invention solves this problem by providing for controlled condensation of water vapor simultaneously with said temperature control making use of said built-in cooling system for causing the condensation. Furthermore, the condensation water formed may be recovered. By means of the invention direct (by directly circulating air) and indirect (by said heat exchange system in the covering) reduction of the indoor temperature can take place without any condensation of moisture at undesired spots such as the inner side of walls, on windows etc.

The system according to the invention is particularly suitable for use in warm countries, desert areas, etc. where there is a shortage of water, but it is generally useful in places with high temperatures and/or high atmospheric humidity. The system according to the invention can be used for dehumidifying any kind of air ventilated space surrounded by an outer covering such as houses, apartment and office buildings, indoor baths, wash houses, laundries, cattle sheds and the like. It should also be noticed that the system according to the invention also replaces conventional distribution systems for fresh and off-air, as well as heat recovery devices for off-air.

In accordance with the invention a conduit system for e.g. a circulating cooling liquid forms part of the covering of a space to be dehumidified (for example the built-in conduit system disclosed in the above-mentioned German "Offenlegungsschrift" No. 27 29 635). This first conduit system is surrounded by drained air spaces, for example positioned in larger conduits than said first conduit system. The air to be dehumidified is passed through said air spaces in heat exchanging contact with said first cooling system. Efficient cooling and dehumidification of the air is obtained when the temperature of the circulating cooling fluid in the inner conduit system has a lower temperature than the surrounding air to be dehumidified. The heat carrying medium, which preferably is an aqueous cooling liquid, can be heat exchanged with an arbitrary cooling source such as a ground accumulator (preferably as disclosed in my previously mentioned German "Offenlegungsschrift" No. 27 29 635), ice-cooling devices, and the like.

A preferred embodiment of the system according to the invention will now be described more in detail with reference to the accompanying drawing, wherein FIG. 1 is a longitudinal sectional view (taken along C—C in FIG. 3) of a device according to the invention, FIG. 2 is a sectional view taken along A—A in FIG. 1, and FIG. 3 is a sectional view taken along B—B in FIG. 1.

In the embodiment shown the system according to the invention comprises one or more module blocks. Each module block comprises a first tube system 1 for circulating a cooling liquid (which e.g. may correspond to the tube system described in may German "Offenlegungsschrift" No. 27 29 635 mentioned above). The tube system 1 comprises an inlet tube 1*a*, an outlet tube 1*b* and a plurality of parallel tube sections 1*c*, which connect the inlet 1*a* with the outlet 1*b*. The first tube sections 1*c* are surrounded by larger tube sections 2*c* of a second tube system 2 for air to be dehumidified. The second tube system 2 further comprises air inlet connections 2*b* (at the top) and outlet connections 2*a* (at the bottom) for dehumidified air. The tube system 2 is also connected to a space 3 (e.g. tubes) for collecting condensed water. The module block is to be used as a part of (or the whole of) a covering surrounding an air ventilated space to be dehumidified, typically forming part of the walls and/or roof of a building. Humid air (which may be ambient air or recycled ventilation air, as explained below) is passed into the system 2 by means of inlets 2*b*. When contacting the cooling tube sections 1*c* (inside tube sections 2*c*) the air is cooled and water vapor contained therein is condensed, the condensed water being collected in the space 3. The dehumidified cool air is then, via the outlets 2*a*, passed into the space to be ventilated (and cooled). After having been used for this purpose the ventilation air can be discharged to the ambient air, or be recirculated, i.e. again be passed into the system 2 via the inlets 2*b*, or be partly discharged and partly recirculated.

In the embodiment shown the tube systems 1, 2, 3 are embedded in a body 4 of a preferably heat insulating material such as plastic foam, plastic foam mixed with peat or other material, to form a suitable rigid module block. The tubes are preferably cast in said material together with a desired facade cladding or the like as shown in FIG. 3. The tube systems may alternatively be applied directly on existing roofs, walls, etc., with or without using an interconnecting insulating body, a suitable cladding being applied afterwards.

The tube systems and the module blocks according to the invention are primarily intended to be positioned in or to constitute the outer covering of a building, but they may also be used for e.g. interior walls, etc. By a slight modification of the condensation draining tubes 2 the tube systems and module blocks may also be arranged horizontally and placed in attic spaces, creep spaces etc. for heat recovery without any risk for condensation damages. The water collecting space 3 is preferably provided with a water seal (so that the air is not blown out the wrong way), and this water seal may be common for a whole house, etc. A spillway 5 is preferably used for avoiding excessive accumulation of water in the system 2, which preferably also is provided with means (not shown) for discharging water therefrom.

The invention is, of course, not restricted to the above described embodiment or the indicated uses, but many modifications and variations are possible within the scope of the general inventive idea. It may, for example, be mentioned that a plurality of module blocks, etc. according to the invention may be connected in series or in parallel to form larger units.

What I claim is:

1. A system for drying humid air to be used for ventilating a space, said system comprising:

a solid module block forming at least part of the outer walls and roof of a structure enclosing said space;

a ventilating conduit system, for supplying air to said space, embedded within the module block and having a plurality of air carrying sections defining ventilation paths;

a coolant conduit system having a plurality of sections connected in parallel for circulating a cooling fluid, the cooling fluid sections being disposed within the air carrying sections and being in heat exchanging relationship with the air flowing in the air carrying sections; and, means for collecting water embedded in said module block and connected to said air carrying sections so as to be out of said ventilating paths, whereby water vapor contained in the supply air in the ventilation paths will condense out and run into the water collecting means, accumulating therein without impeding the air flow through the ventilation paths.

2. The system of claim 1, wherein said coolant conduit system further comprises:

at least one cooling fluid inlet tube communicating outside the module block;

at least one cooling fluid outlet tube communicating outside the module block; and, a plurality of parallel tubes connected to said cooling fluid inlet and outlet tubes; and said ventilating conduit system further comprising:

at least one inlet tube for said supply air to be de-humidified;

at least one outlet tube communicating with the space for the de-humidified air; and, a plurality of parallel tubes connected to said air supply inlet and outlet tubes, each said air supply tube being concentric with, spaced from and enclosing at least one of said cooling fluid tubes.

3. The system of claim 1 wherein said module block comprises a body of insulating material, said conduit systems being embedded in said insulating material.

4. The system of claim 1, wherein said ventilating conduit system is connected to a source of fresh air for supplying said space.

5. The system of claim 1, wherein the air carrying sections in the ventilation paths of the ventilating conduit system and the cooling fluid sections disposed therein comprise concentric tubes, the tubes of the cooling fluid sections having a smaller diameter than the tubes of the air carrying sections.

* * * * *

UNITED STATES PATENT AND TRADEMARK OFFICE

CERTIFICATE OF CORRECTION

PATENT NO. : 4,314,603

DATED : 02/09/82

INVENTOR(S) : Anders D. Backlund

It is certified that error appears in the above-identified patent and that said Letters Patent are hereby corrected as shown below:

Column 2, line 21, "may" should be —my—.

Column 2, line 65, "for" second occurrence should be --of--.

Signed and Sealed this

First Day of June 1982

[SEAL]

Attest:

GERALD J. MOSSINGHOFF

Attesting Officer

Commissioner of Patents and Trademarks